US008571247B1

(12) United States Patent
Oezer

(10) Patent No.: US 8,571,247 B1
(45) Date of Patent: Oct. 29, 2013

(54) HEARING AID INSERTION TOOL

(76) Inventor: John J. Oezer, Bradenton, FL (US)

( * ) Notice: Subject to any disclaimer, the term of this patent is extended or adjusted under 35 U.S.C. 154(b) by 111 days.

(21) Appl. No.: 13/212,753

(22) Filed: Aug. 18, 2011

(51) Int. Cl.
*H04R 25/00* (2006.01)

(52) U.S. Cl.
USPC ..... 381/329; 381/328; 381/330

(58) Field of Classification Search
USPC ..... 381/322, 324, 325, 328, 329, 331; 181/129, 130, 135
See application file for complete search history.

(56) References Cited

U.S. PATENT DOCUMENTS

| | | | | |
|---|---|---|---|---|
| 2,585,098 | A | 2/1952 | Elliott | |
| 4,565,904 | A | 1/1986 | Harada | |
| 5,003,608 | A | 3/1991 | Carlson | |
| 5,195,523 | A * | 3/1993 | Cartmell et al. | 600/391 |
| 6,055,319 | A | 4/2000 | Shennib et al. | |
| 7,246,540 | B2 | 7/2007 | Rillera | |
| 2005/0179274 | A1 | 8/2005 | Lera | |
| 2009/0082801 | A1 * | 3/2009 | Giese et al. | 606/210 |

* cited by examiner

*Primary Examiner* — Suhan Ni
(74) *Attorney, Agent, or Firm* — Montgomery Patent & Design; Robert C. Montgomery

(57) ABSTRACT

A hearing aid insertion tool assists a user in the insertion and removal of hearing aids into and from an ear. The tool includes a handle, a thumb pad, and a spring clip. The spring clip is adapted to releasably clamp an ear-piece portion of a hearing aid, such that a user can utilize the tool to subsequently guide the ear-piece into their ear. Once the ear-piece is in place, the user can squeeze the spring clip to release the tool from the hearing aid. The tool is provided in a short-handled embodiment which provides a smaller overall construction adapted for travel and a long-handled embodiment for use at home or by users with diminished strength or dexterity.

19 Claims, 6 Drawing Sheets

HEARING AID INSERTION TOOL

RELATED APPLICATIONS

The present invention was first described in a notarized Official Record of Invention on Nov. 17, 2010, that is on file at the offices of Montgomery Patent and Design, LLC, the entire disclosures of which are incorporated herein by reference.

FIELD OF THE INVENTION

The present invention relates generally to hearing aid retaining tools, and in particular, to a handled tool for releasably grasping hearing aids for insertion into and removal from the ear or ear canal of a user.

BACKGROUND OF THE INVENTION

Hearing aids are used by a large number of people to help restore their hearing to a suitable level. Whether the hearing loss was caused by an accident, excessive loud noise, old age, a genetic abnormality, or the like, the hearing aid allows these people to overcome their disability and become a fully functioning member of society. Current hearing aid technology often utilizes a discreet transducer that is used in the ear canal along with a larger component that is mounted behind the ear. However, as the technology improves and components become smaller, it becomes more difficult for such items to be properly placed. Those who are elderly, disabled, or suffering from reduced dexterity often find it difficult to hold such small items, much less place them properly.

Typically a user must attempt to insert the hearing aid with the fingers. Unfortunately, this method is often difficult and frustrating. As an alternative, some users resort to usage of tweezers which are not suited to control delicate hearing aids. Accordingly, there remains a need for a device that addresses these problems.

SUMMARY OF THE INVENTION

The inventor has therefore recognized the aforementioned inherent problems and lack in the art and observed that there is a need for a means by which hearing aid transducers can be more easily installed and removed from the ear canal in view of difficulties described. In accordance with the invention, it is an object of the present embodiments to solve at least one of these problems.

The inventor recognized these problems and has addressed this need by developing a hearing aid insertion tool that provides the ability to insert and remove hearing aid transducers in a manner which is quick, easy and effective. The inventor has thus realized the advantages and benefits of providing a handled hearing aid insertion tool having a lower jaw including a lower grip end and a lower actuating end opposite the lower grip end. An upper jaw is hingedly attached to the lower jaw by a pivot pin for providing pivoting movement of the upper jaw relative to the lower jaw. The upper jaw includes an upper grip end and an upper actuating end opposite the upper grip end. A spring is disposed about the pivot pin hand has opposing ends in contact with the lower actuating end and the upper actuating end. A cylindrical handle having a rubberized exterior is affixed to the lower actuating end. A thumb pad having a rectangular body and a flat top surface for supporting a thumb of a user's hand is affixed to the upper grip end. The opposing ends of the spring apply a spring force upon the lower actuating end and the upper actuating end for biasing the lower grip end and the upper grip end in a closed position. Application of a compression force upon the handle and the thumb pad moves the lower grip end and the upper grip end into an open position. A hearing aid is removably retainable between the lower grip end and the upper grip end for insertion into and removal from an ear or ear canal.

In an embodiment of the invention, a storage pouch is provided including a pouch body having an open top which defines an inner space adapted to retain at least one (1) tool. A flap is affixed to an edge of the open top for covering the inner space. A flap retainer is provided having opposing ends affixed to sides of the pouch body and laterally extending across an upper portion of the pouch body. An end of the flap is retained between an exterior of the pouch body and an interior of the flap when covering the inner space.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

| DESCRIPTIVE KEY | |
|---|---|
| 20 | short handled hearing aid insertion tool |
| 22 | first lower jaw |
| 24 | upper jaw |
| 26 | pivot pin |
| 28 | serrated edge |
| 30 | spring |
| 40 | short handle |
| 50 | thumb pad |
| 80 | long handled hearing aid insertion tool |
| 82 | long handle |
| 86 | second lower jaw |
| 100 | user |
| 110 | hearing aid |

-continued

| DESCRIPTIVE KEY | |
|---|---|
| 115 | ear/ear canal |
| 120 | storage pouch |
| 122 | body |
| 124 | inner space |
| 126 | flap |
| 128 | flap retainer |

DETAILED DESCRIPTION OF THE PREFERRED EMBODIMENT

Figure 1:
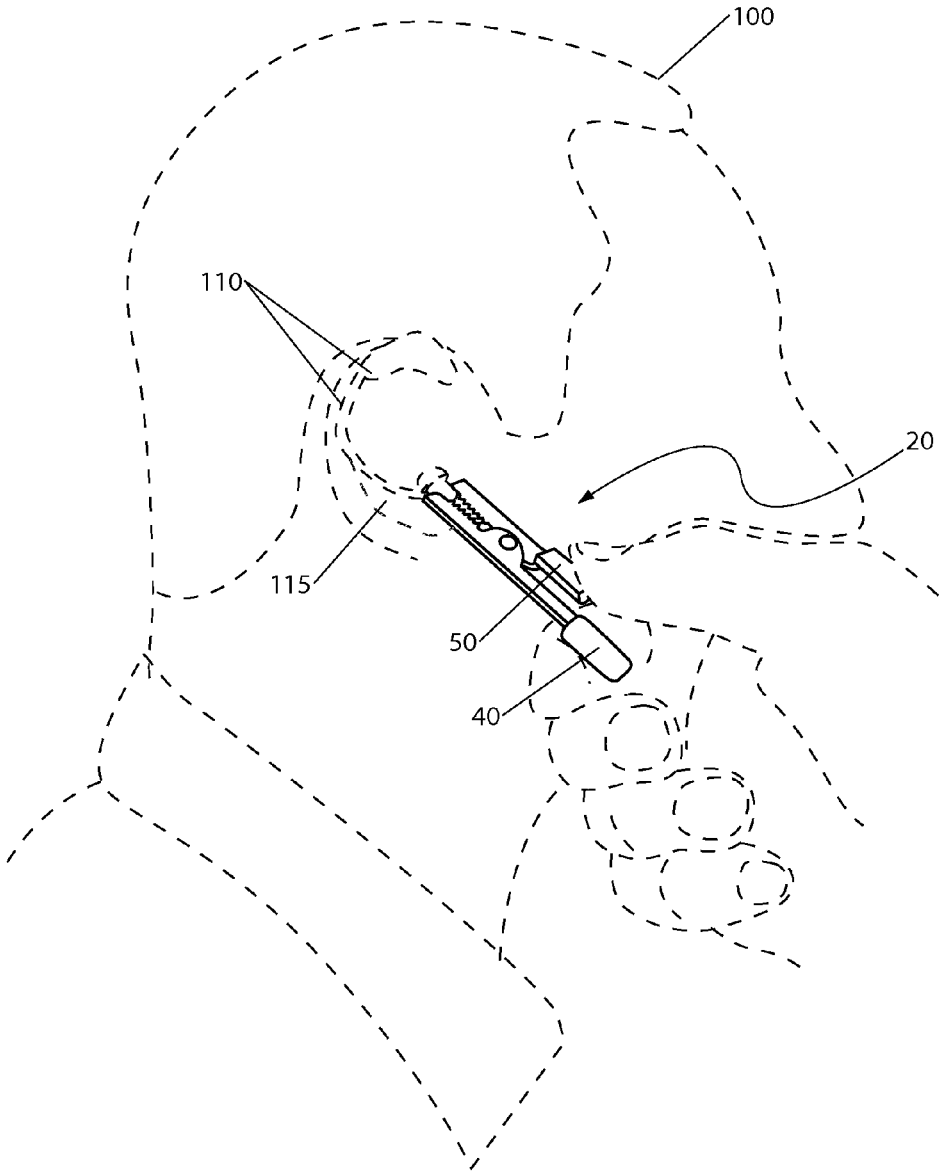
FIG. 1 is an environmental view of a handled hearing aid insertion tool, according to a preferred embodiment in accordance with the invention.
Figure 2A:
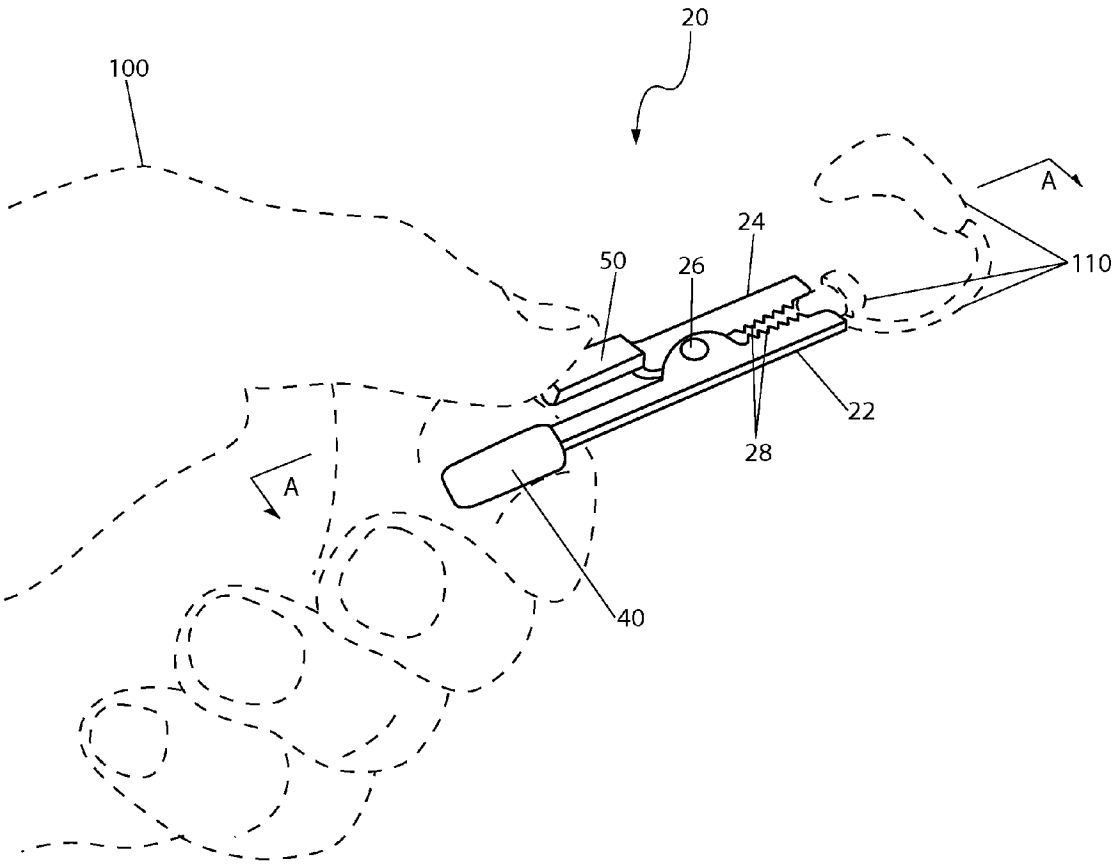
FIG. 2*a* is a close-up environmental view of the handled hearing aid insertion tool, according to the preferred embodiment.
Figure 2B:
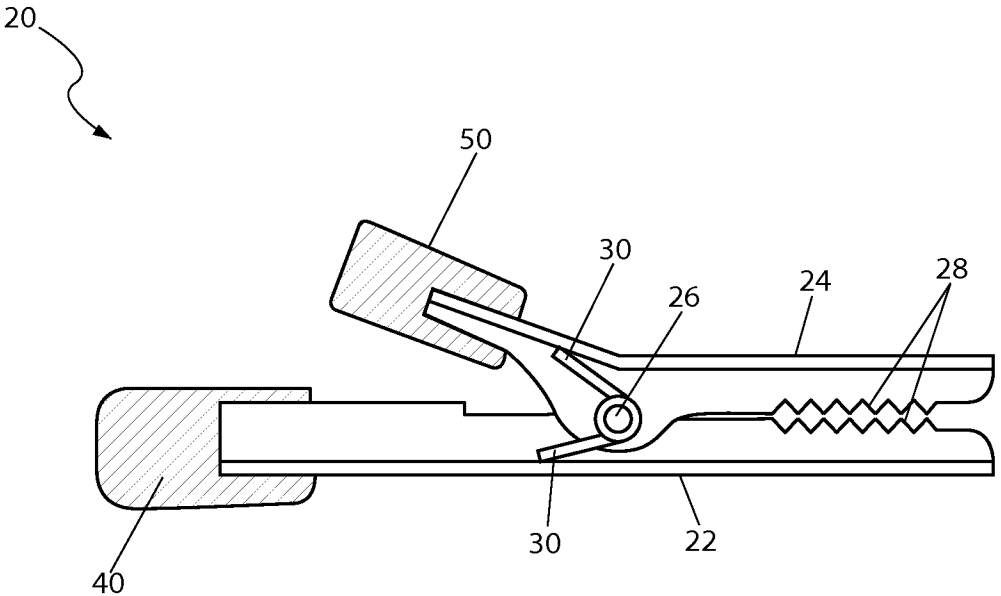
FIG. 2*b* is a section view of the handled hearing aid insertion tool taken along section line A-A of FIG. 2*a*, according to the preferred embodiment.
Figure 3A:
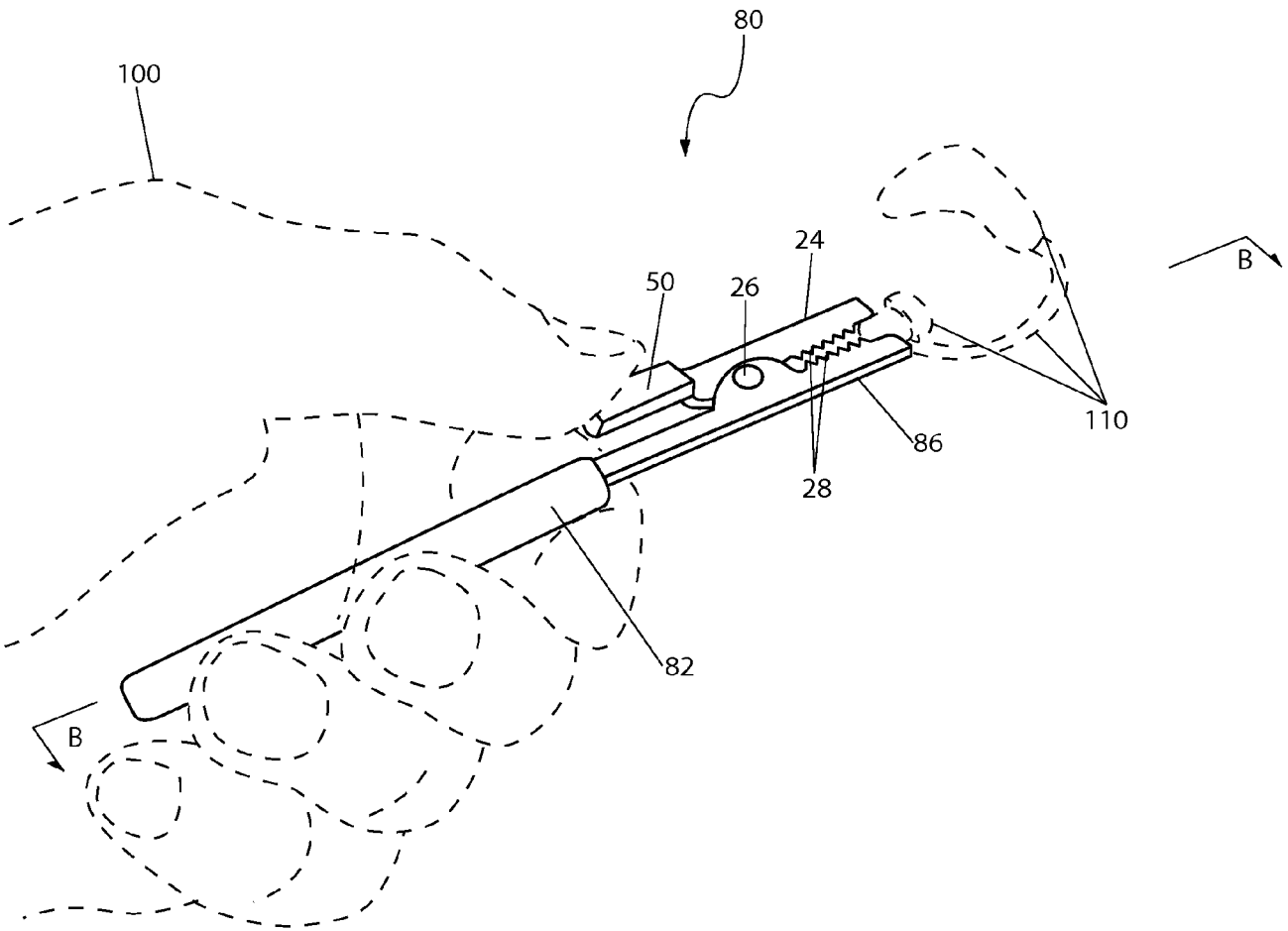
FIG. 3*a* is a close-up view of the handled hearing aid insertion tool, according to an alternate embodiment in accordance with the invention.
Figure 3B:
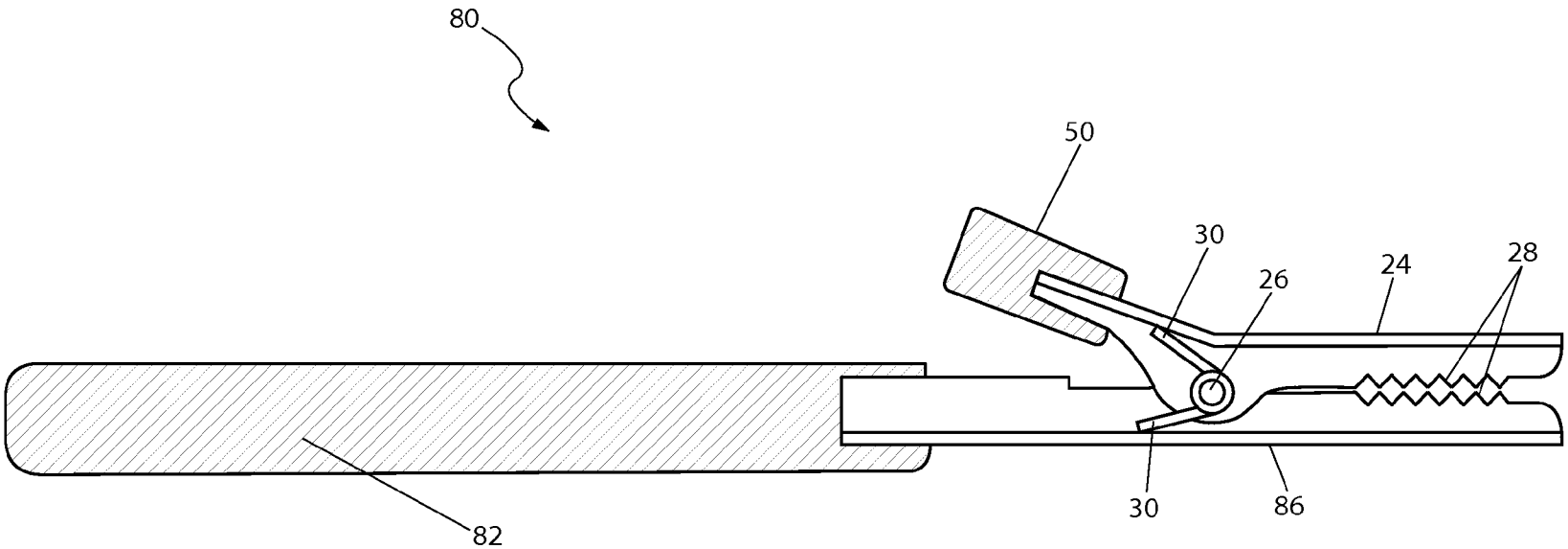
FIG. 3*b* is a section view of the handled hearing aid insertion tool taken along section line B-B of FIG. 3*a*, according to an alternate embodiment; and, FIG. 4 is a perspective view of a storage pouch for the handled hearing aid insertion tool, according to the preferred and alternate embodiments.

In accordance with the invention, the best mode is presented in terms of a preferred embodiment, herein depicted within FIGS. 1, 2*a*, 2*b* and 4, and in terms of an alternate embodiment, herein depicted within FIGS. 3*a* and 3*b*. However, the disclosure is not limited to a single described embodiment and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

The terms "a" and "an" herein do not denote a limitation of quantity, but rather denote the presence of at least one of the referenced items.

Referring now to FIGS. 1 through 3, depicting a handled hearing aid insertion tool (herein described as a "device") 10, where like reference numerals represent similar or like parts. In accordance with the invention, the present disclosure describes a device 10 which assists in insertion and removal of hearing aid devices 110 into and from the ear/ear canal 115. The device 20 is especially useful when used to manipulate hearing aids 110 such as in-the-ear types (ITE) and in-the-canal types (ITC).

FIGS. 1 and 2*a* show an environmental view and a close-up view of the device 10 in terms of the preferred embodiment, a short handled hearing aid insertion tool 20. The short handled hearing aid insertion tool 20 is depicted having a short handle and a spring-loaded clip assembly. The clip assembly is approximately two (2) inches in length and includes a first lower jaw 22 and an upper jaw 24 which are similar in construction and function as an "alligator clip". The upper jaw 24 is hingedly attached at a generally central location to the first lower jaw 22. The forward ends of the first lower jaw 22 and the upper jaw 24 are biased in a closed position by a spring. The spring is disposed between opposing inner surfaces of the jaws 22, 24 about the hinge, such that the front ends are in contact with one (1) another.

A short handle 40 is affixed to an end of the first lower jaw 22. A thumb pad 50 is affixed to an end of the upper jaw 24 and provides a gripping surface for holding the device 20 to facilitate easy orientation and leverage of the hearing aid 110 during the insertion and removal. The short handle 40 is permanently molded and rearwardly extends from the first lower jaw 22. The short handle 40 has a cylindrical body approximately between one-half (½) and one (1) inch long and is preferably made of molded rubber or hard plastic to provide secure gripping. The thumb rest 50 is a molded rubber or plastic appendage having a generally rectangular shape and a flat top surface to provide added stability when using the fingers to hold the short handled hearing aid insertion tool 20. The use of the short handled hearing aid insertion tool 20 allows an index finger and a thumb of the same hand to press the short handle 40 and a thumb pad 50 together simultaneously to open the jaws 22, 24.

The short handled hearing aid insertion tool 20 is particularly useful when compact storage is required or space is limited, such as during traveling or when at a non-permanent location. The short handled hearing aid insertion tool 20 is transported and stored within a storage pouch 120 (see FIG. 4).

FIG. 2*b* shows a section view of the short handled hearing aid insertion tool 20 taken along section line A-A of FIG. 2*a*. The jaws 22, 24 are in mechanical communication with each other at an intermediately located and laterally connected pivot pin 26 which provides for axial mounting of the jaws 22, 24 to the internal torsion spring 30. The spring 30 applies a force to rear portions of each jaw 22, 24, thereby holding the jaws 22, 24 closed and under the spring force when the thumb pad 50 and short handle 40 are released. The forwardly extending portion of each jaw 22, 24 each include an inwardly-facing serrated edge 28 to provide a positive grip upon the earpiece portion of the hearing aid 110 (see FIG. 2*a*).

FIGS. 3*a* and 3*b* show a close-up view and section view of the device 10 in terms of an alternate embodiment, a long handled hearing aid insertion tool 80. The of the device in terms of the preferred embodiment 80 includes substantially similar construction and function as the short handled hearing aid insertion tool 20; however, the long handled hearing aid insertion tool 80 includes a long handle 82 and an elongated and rearwardly extending second lower jaw 86. The long handled hearing aid insertion tool 80 is approximately three (3) to four (4) inches in length and is especially useful at home and other permanent locations and especially convenient for users 100 having reduced hand strength or dexterity. The long handle 82 provides an increased gripping surface for use of a plurality of fingers.

Figure 4:
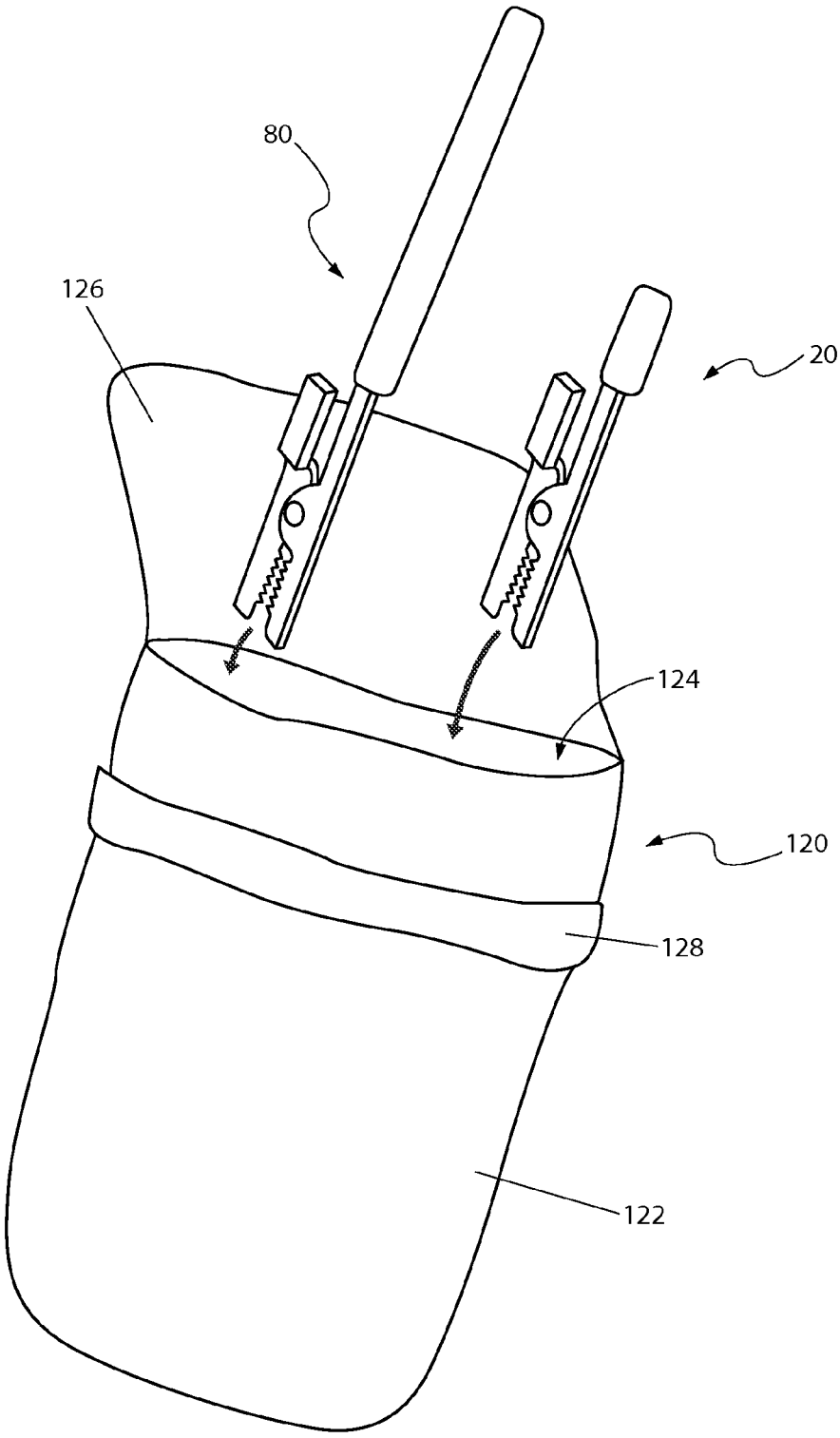

FIG. 4 shows a perspective view of a storage pouch 120. Both the short handled hearing aid insertion tool 20 and the long handled hearing aid insertion tool 80 can be protectively stored within the storage pouch 120. The storage pouch 120 provides a way to transport and protect both embodiments 20, 80 as well as provides ample inner space 124 for associated hearing aid supplies such as, but not limited to: batteries, cleaning tools, wipes, lubricant, and the like. The storage pouch 120 includes an elliptically-shaped body 122 with an open top, a flap 126, and a flap retainer 128. The body 122, the flap 126, and the flap retainer 128 are made of a flexible textile material such as vinyl, leather, or the like and are provided in various colors and patterns. The flap retainer 128 is a strip of material which extends laterally across a front surface of the body 122 having opposing ends that are anchored to the body 122. In use, the flap 126 is downwardly inserted into the flap retainer 128 to form an enclosure around the included embodiments 20, 80.

It can be appreciated by one skilled in the art that other styles and configurations of the invention can be easily incorporated into the teachings of the present disclosure and only two (2) particular configurations have be shown and described for purposes of clarity and disclosure and not by way of limitation of scope.

In accordance with the invention, the preferred and alternate embodiments can be utilized by the user in a simple and effortless manner with little or no training. After initial purchase or acquisition of the device 10, it is installed and utilized as indicated in FIGS. 1 through 4.

The method of utilizing a short handled hearing aid insertion tool 20 can be achieved by performing a series of steps including, but not limited to the following steps. Procuring a pouch 120 with at least one (1) short handled hearing aid insertion tool 20 stored inside. Opening the flap 126 of the pouch 120 and removing the short handled hearing aid insertion tool 20. Positioning index finger and thumb of the user's 100 hand upon respective short handle 40 and thumb pad 50 and squeezing the short handle 40 and thumb pad 50 together to open the forward ends of the jaws 22, 24. Inserting a rearward portion of the earpiece of the hearing aid 110 between the jaws 22, 24 using a free hand, such that the inserted portion of the hearing aid 110 extends forwardly from the jaws 22, 24. Releasing the short handle 40 and thumb pad 50 to secure the hearing aid 110 between the jaws 22, 24. Holding the short handled hearing aid insertion tool 20 and directing the earpiece portion of the hearing aid 110 into the ear/ear canal 115 and releasing the earpiece portion of the hearing aid 110 within the ear/ear canal 115 of the user 100 by squeezing the short handle 40 and thumb pad 50 together to open the jaws 22, 24. Retracting the short handled hearing aid insertion tool 20 from the ear/ear canal 115 and benefiting from having an improved grip and control of a hearing aid 110 during insertion into one's 100 ear/ear canal 115.

In an event that two (2) hearing aids 110 are inserted, the above procedure can be repeated, as the short handled hearing aid insertion tool 20 can be utilized for a left or right ear/ear canal 115 of the user 100 with equal benefit.

The procedure described above can be reversed to remove the ear piece portion of the hearing aid 110 or the hearing aid 110 can also be removed by utilizing a pull tab portion of the hearing aid 110, if so equipped, or by pulling the wire or sound tube portions, if so equipped.

The method of utilizing the alternate long handled hearing aid insertion tool 80 of the device 10 can be achieved by performing a series of steps substantially similar to those described for the short handled hearing aid insertion tool 20. However, the long handled hearing aid insertion tool 80 provides improved gripping capability by allowing grasping of the long handled hearing aid insertion tool 80 using a plurality of fingers due to the length of the long handle 82, thereby being especially useful when utilized at permanent locations such as home, or when utilized by users 100 having reduced strength or dexterity.

The foregoing descriptions of specific embodiments have been presented for purposes of illustration and description. They are not intended to be exhaustive or to limit the invention and method of use to the precise forms disclosed. Various modifications and variations can be appreciated by one skilled in the art in light of the above teachings. The embodiments have been chosen and described in order to best explain the principles and practical application in accordance with the invention to enable those skilled in the art to best utilize the various embodiments with expected modifications as are suited to the particular use contemplated. It is understood that various omissions or substitutions of equivalents are contemplated as circumstance may suggest or render expedient, but is intended to cover the application or implementation without departing from the spirit or scope of the claims of the invention.

What is claimed is:

1. A hearing aid insertion tool comprising:

an upper jaw pivotably attached to said lower jaw, further comprising an rearward end and an upper actuating end opposite said upper grip end, said rearward end being disposed at a non-zero angle with respect to said forward end; and, a lower jaw comprising a rearward end affixed to said handle and a forward end opposite said rearward end, said rearward end of said lower jaw being longer than said rearward end of said upper jaw;

a thumb pad affixed to said rearward end of said upper jaw, said thumb pad comprising a width and a thickness substantially greater that said upper jaw;

a handle affixed to said rearward end of said lower jaw, said handle comprising a length substantially greater than said thumb pad;

wherein said forward ends of said upper jaw and said lower jaw are biased together; and wherein said forward ends of said upper jaw and said lower jaw are configured to operably grip at least a portion of a hearing aid for insertion into and removal from an ear.

2. The tool of claim 1, wherein said lower jaw is hingedly attached to said upper jaw by a pivot pin between said rearward ends and said forward ends for providing pivoting movement of said upper jaw relative to said lower jaw.

3. The tool of claim 2, further comprising a spring disposed about said pivot pin having opposing ends in contact with said rearward ends of said upper jaw and said lower jaw;

wherein said opposing ends of said spring apply a spring force upon said rearward ends for biasing said forward ends of said upper jaw and said lower jaw together in a closed position; and, wherein application of a compression force upon said handle and said thumb pad moves said forward ends of said upper jaw and said lower jaw in an open position.

4. The tool of claim 3, wherein said forward end of said upper jaw comprises a serrated inner surface.

5. The tool of claim 3, wherein said forward end of said lower jaw comprises a serrated inner surface.

6. The tool of claim 3, wherein said forward ends of said upper jaw and said lower jaw each comprises an inner surface having serrated edges.

7. The tool of claim 3, wherein said handle is molded over at least a portion of said rearward end of said lower jaw.

8. The tool of claim 7, wherein said handle further comprises a rubberized exterior.

9. The tool of claim 7, wherein said thumb pad is molded over said rearward end of said upper jaw.

10. The tool of claim 9, wherein said handle and said thumb pad each comprises a rubberized exterior.

11. The tool of claim 3, wherein said thumb pad further comprises a rectangular body and a flat top surface for supporting a thumb of a user's hand.

12. The tool of claim 3, further comprising a storage pouch comprising a pouch body with an open top defining an inner space adapted to retain at least one said tool.

13. The tool of claim 12, wherein said storage pouch further comprises a flap affixed to an edge of said open top for covering said inner space.

14. The tool of claim 13, wherein said storage pouch further comprises a flap retainer having opposing ends affixed to sides of said pouch body and laterally extending across an upper portion of said pouch body;

wherein an end of said flap is retained between an exterior of said pouch body and an interior of said flap when covering said inner space.

15. A handled hearing aid insertion tool comprising:

a lower jaw comprising a rearward end and a forward end opposite said rearward end;

an upper jaw hingedly attached to said lower jaw by a pivot pin for providing pivoting movement of said upper jaw relative to said lower jaw, said upper jaw comprising a rearward end and a forward end opposite said rearward end;

said rearward end of said upper jaw being disposed at a non-zero angle with respect to said forward end of said upper jaw;

said rearward end of said lower jaw being longer than said rearward end of said upper jaw;

a spring disposed about said pivot pin having opposing ends in contact with said rearward ends of said lower jaw and said upper jaw;

a thumb pad comprising a rectangular body and a flat top surface for supporting a thumb of a user's hand affixed to said rearward end of said upper jaw, said thumb pad comprising a width and a thickness substantially greater than said upper jaw;

a cylindrical handle comprising a rubberized exterior affixed to said rearward end of said lower jaw, said handle comprising a length substantially greater than said thumb pad;

wherein said opposing ends of said spring apply a spring force upon said rearward end of said lower jaw and said upper jaw for biasing said forward ends of said lower jaw and said upper jaw together in a closed position;

wherein application of a compression force upon said handle and said thumb pad moves said forward ends of said lower jaw and said upper jaw into an open position; and, wherein said forward ends of said upper jaw and said lower jaw are configured to operably grip at least a portion of a hearing aid for insertion into and removal from an ear.

16. The tool of claim 15, wherein said forward ends of said lower jaw and said upper jaw each comprises an inner surface having serrated edges.

17. The tool of claim 16, further comprising a storage pouch comprising:

a pouch body with an open top defining an inner space adapted to retain at least one said tool;

a flap affixed to an edge of said open top for covering said inner space; and, a flap retainer having opposing ends affixed to sides of said pouch body and laterally extending across an upper portion of said pouch body;

wherein an end of said flap is retained between an exterior of said pouch body and an interior of said flap when covering said inner space.

18. The tool of claim 16, wherein said upper grip end and said lower grip end each further comprises an inner surface having serrated edges.

19. The tool of claim 16, wherein said handle is approximately between one-half and one inch long.

* * * * *